United States Patent [19]

Schollmeier

[11] Patent Number: 4,517,021

[45] Date of Patent: May 14, 1985

[54] SEMI-CRYSTALLINE FRUCTOSE

[75] Inventor: Charles E. Schollmeier, Decatur, Ill.

[73] Assignee: A. E. Staley Manufacturing Company, Decatur, Ill.

[21] Appl. No.: 546,348

[22] Filed: Oct. 28, 1983

[51] Int. Cl.[3] ..... C13K 11/00

[52] U.S. Cl. ..... 127/30; 127/60

[58] Field of Search ..... 127/30, 58, 60, 61

[56] References Cited

U.S. PATENT DOCUMENTS

| | | | |
|---|---|---|---|
| 2,369,231 | 2/1945 | Harding | 127/58 |
| 2,854,359 | 9/1958 | Wilson et al. | 127/30 |
| 3,239,378 | 3/1966 | Opila | 127/60 |
| 3,513,023 | 5/1970 | Kusch et al. | 127/30 |
| 3,607,392 | 9/1971 | Lauer et al. | 127/15 |
| 3,816,175 | 6/1974 | Melaja | 127/30 |
| 3,883,365 | 5/1975 | Forsberg et al. | 127/60 |
| 3,928,062 | 12/1975 | Yamauchi | 127/30 |
| 3,929,503 | 12/1975 | Yamauchi | 127/58 |
| 3,956,009 | 5/1976 | Lundquist et al. | 127/62 |
| 4,199,373 | 4/1980 | Dwivedi et al. | 127/30 |
| 4,371,402 | 2/1983 | Kubota | 127/60 |

*Primary Examiner*—Peter Hruskoci

*Attorney, Agent, or Firm*—Philip L. Bateman; Forrest L. Collins

[57] ABSTRACT

A solid fructose product comprising less than about 2 weight percent water and greater than about 60 weight percent crystalline fructose is prepared by combining an aqueous fructose syrup and a solid crystallization initiator and then contacting with air for about 12 to 48 hours. The fructose syrup comprises about 60 to 93 weight percent saccharide with about 85 to 100 weight percent of the saccharide being fructose. The air has an initial temperature of about 50° to 80° C. and a final relative humidity of less than about 20 percent.

10 Claims, 2 Drawing Figures

SEMI-CRYSTALLINE FRUCTOSE

FIELD OF THE INVENTION

This invention relates to semi-crystalline fructose. More particularly, one embodiment of this invention relates to a process for preparing a semi-crystalline solid fructose product comprising less than about 2 weight percent water and greater than about 60 weight percent crystalline fructose. Another embodiment of this invention relates to a semi-crystalline fructose composition comprising less than about 2 weight percent water and greater than about 60 weight percent crystalline fructose.

BACKGROUND OF THE INVENTION

A. Solid Sugars In General

Many solids exist in both crystalline and amorphous forms. Crystals are characterized by an orderly three-dimensional arrangement of molecules in a lattice whereas amorphous solids are characterized by a random arrangement of molecules. The physical properties of the solid often differ markedly depending upon how the molecules are arranged. For example, the physical properties of the element carbon in its amorphous state (e.g., charcoal and coal) and in either of its two crystalline forms (graphite and diamond) are considerably different. It is common for solids to include both crystalline and amorphous formations within the same particle. As used herein, the term "crystalline" refers to a solid having essentially no amorphous formations, the terms "non-crystalline" and "amorphous" refer to a solid having very minor (less than about 10 weight percent) amounts of crystalline formations, and the term "semi-crystalline" refers to a solid having both crystalline and amorphous formations.

Most sugars, including sucrose, glucose (also called dextrose), and fructose, exist in both crystalline and amorphous forms. Crystalline sugars (e.g., common table sucrose) are generally free-flowing granules whereas amorphous sugars tend to agglomerate into a sticky and viscous mass. Therefore, the crystalline form of a sugar is desired for its improved physical properties. Unfortunately, the most common process for producing crystalline sugars, aqueous crystallization, is relatively slow and costly.

The starting point for any crystallization is to obtain a supersaturated solution of the solute to be crystallized in an appropriate solvent. The supersaturated solution is generally achieved by cooling and/or evaporating an unsaturated solution. Although it is an oversimplification, supersaturated solutions are commonly referred to as either metastable or unstable (also called labile) to characterize their behavior. For example, at 20° C., a saturated solution of sucrose in water contains about 2.0 grams sucrose per gram water. If this saturated solution is then cooled and/or evaporated, it initially enters the metastable phase. In the metastable phase, spontaneous crystallization is improbable, but will occur if seed crystals are introduced. If cooling and/or evaporating is continued, the unstable phase is eventually reached and spontaneous crystallization occurs. Most commercial operations induce crystallization in the metastable phase by seeding the solution with previously-formed crystals.

Despite the fact that cooling and/or evaporating aqueous crystallization is slow and costly, it is the major commercial process for producing solid sucrose and glucose. Nevertheless, various processes for producing sugars in semi-crystalline or non-crystalline form have been disclosed. These processes are generally simpler, faster, and less expensive than the conventional crystallization technique because: (1) long crystallization cycles are avoided; (2) the particle size of the product can be determined by mechanical means independently of crystal size; (3) cooling is often eliminated; and (4) the entire product is often recovered without recycle. Therefore, sugars produced by these processes are sold at lower prices than their crystalline counterparts.

B. Methods of Producing Solid Fructose

Fructose is a highly desirable sugar because it has a sweetness of about 1.3 to 1.8 times (depending on the conditions) that of sucrose. Aqueous fructose solutions are readily available from the isomerization of glucose and from the hydrolysis of sucrose (a fructose-glucose disaccharide) and inulin (a fructose polysaccharide). Unfortunately, because of its physical characteristics, crystalline fructose cannot be easily produced by the conventional technique of cooling and/or evaporating crystallization from water. First of all, fructose is extremely water-soluble (about 3.8 grams fructose per gram water at 20° C.) and the saturated solutions are very viscous. The high viscosity limits the rate of crystal formation and also makes cooling during crystallization impractical because the cooled solution cannot be conveniently handled. Secondly, fructose has a melting point of only about 102° C. and it tends to brown and polymerize to dianhydrides if heated above about 110° C. for extended periods in solution. Therefore, evaporative crystallization is also impractical.

A number of rather exotic techniques have been reported to produce crystalline fructose. For example, Forsberg, U.S. Pat. No. 3,883,365, issued May 13, 1975, discloses a process for crystallizing fructose from water by modification of pH and by careful control of cooling. The Forsberg process is limited by its low yields (about 50 percent) and by its long processing periods (about 120 hours). Lauer, U.S. Pat. No. 3,607,392, issued Sept. 21, 1971, discloses a process for preparing crystalline fructose by dissolving a fructose syrup in hot methanol and then cooling and seeding accompanied by "intensive stirring".

Since crystalline fructose is so difficult to produce, considerable effort has been devoted in the art to produce a free-flowing, granular, semi-crystalline solid fructose product which can be used as a substitute for crystalline fructose. For example, Lundquist, U.S Pat. No. 3,956,009, issued May 11, 1976, discloses a process for preparing particulate fructose products by spray-drying an aqueous fructose solution in the presence of separately introduced recycled dried product solids and then conditioning the warm dried fructose particles to permit some crystallization to occur so as to reduce the tackiness of the product. Kubota, U.S. Pat. No. 4,371,402, issued Feb. 1, 1983, discloses a process for preparing particulate fructose products by dehydrating an aqueous fructose solution in the presence of an organic solvent, e.g. ethanol, aging, and then solidifying the fructose by introduction into anhydrous alcohol. Yamauchi, U.S. Pat. No. 3,929,503, issued Dec. 30, 1975, discloses the preparation of free-flowing fructose particles by kneading an anhydrous fructose powder with an aqueous fructose solution, shaping the kneaded mixture into particles, and then drying the particles.

Despite these efforts, a need still exists for a process which produces free-flowing, granular, semi-crystalline solid fructose without the disadvantages associated with: (1) spray-drying; (2) the use of solvents; (3) pH adjustments; and (4) kneading, working, or otherwise conditioning the solid fructose.

C. Methods of Producing Solid Glucose

Glucose has a relatively low water solubility (about 0.9 grams glucose per gram water at 20° C.) and a relatively high tolerance to heat. Accordingly, glucose solutions can be dried relatively quickly and easily to produce semi-crystalline or non-crystalline glucose. Glucose exists in three crystalline forms (beta anhydrous, alpha anhydrous, and alpha hydrate) which differ in their rates of water solubility. Beta anhydrous crystals are the fastest dissolvers and it is therefore preferable for many applications to maximize the amount of beta anhydrous crystals in a semi-crystalline glucose product. The three references discussed below describe processes which, although employing widely different processing conditions, all allegedly produce a high-beta-content glucose product.

Harding, U.S. Pat. No. 2,369,231, issued Feb. 13, 1945, discloses a process for mixing a 44°–46° Baume dextrose syrup at about 88° to 99° C. with crystalline dextrose at about 82° to 104° C. in a rotary drum dryer and drying the mixture with air having a temperature of about 149° to 177° C. The weight ratio of crystalline dextrose to syrup is about 2:1 to 4:1 and the residence time in the dryer is about 30 to 45 minutes. The mixture leaves the dryer at about 88° to 99° C. and then passes to two separate coolers. The product allegedly contains about 35 percent beta-anhydrous-form crystals.

Wilson, U.S. Pat. No. 2,854,359, issued Sept. 30, 1958, discloses a process for producing a semi-crystalline dextrose having about 40 to 60 percent beta-anhydrous-form crystals. The process comprises mixing a concentrated dextrose syrup at a temperature above about 50° C. with a preformed or self-induced product at a temperature above about 50° C. and then drying and cooling the mixture. The mixture is dried at a temperature not falling below about 50° C. nor rising above the "softening point" of the dried product. In Example I, the air temperature to the dryer was about 82° to 93° C. Wilson states that spray-drying and flash-drying are suitable, but that drying in a rotating kiln is preferred. The weight ratio of product to syrup in the mixture is apparently very low. In Example III, the ratio is only about 0.06:1 on a solids basis.

Opila, U.S. Pat. No. 3,239,378, issued Mar. 8, 1966, also discloses a product for producing a semi-crystalline dextrose having at least about 40 percent beta-anhydrous-form crystals. In the Opila process, a dextrose syrup at about 105° to 150° C. is combined with a dextrose seed bed at about 10° to 40° C. and the mixture is then mixed for about 5 to 15 minutes to induce substantially complete crystallization. The mixture is then cooled and dried with air at a temperature of about 5° to 35° C. in an air line or a fluidized bed dryer.

Because of the differences in physical properties between glucose and fructose, there is no suggestion that any of the above processes is suitable for preparing semi-crystalline fructose.

SUMMARY OF THE INVENTION

The general objects of this invention are to provide an improved process for preparing solid fructose and to provide an improved solid fructose composition. A more particular object of one embodiment of this invention is to provide an improved process for preparing free-flowing, granular, semi-crystalline, solid fructose. A more particular object of another embodiment of this invention is to provide an improved free-flowing, granular, semi-crystalline solid fructose composition having reduced hygroscopicity.

I have discovered a new and improved process for preparing free-flowing, granular, semi-crystalline, solid fructose. The process comprises the following three steps: (a) combining together an aqueous fructose syrup comprising about 60 to 93 weight percent saccharide, about 85 to 100 weight percent of the saccharide being fructose, and a solid crystallization initiator in a weight ratio of crystallization initiator to fructose syrup of about 5:1 to 40:1; (b) contacting the combined fructose syrup and crystallization initiator with air having an initial temperature of about 50° to 80° C. and a final relative humidity of less than about 20 percent for a period of time of about 12 to 48 hours to transform the combined fructose syrup and crystallization initiator to a free-flowing, granular, solid fructose product comprising less than about 2 weight percent water and greater than about 60 weight percent crystalline fructose; and (c) recovering the free-flowing, granular, semi-crystalline, solid fructose product.

This process produces free-flowing, granular, semi-crystalline, solid fructose without the disadvantages associated with: (1) spray-drying; (2) the use of solvents, such as alcohols; (3) pH adjustment; and (4) kneading, working, or otherwise conditioning the solid fructose. The solid fructose can be used as a substitute for crystalline fructose and/or crystalline sucrose.

I have also discovered a new and improved free-flowing, granular, semi-crystalline, solid fructose composition. The composition consists essentially of: (a) less than about 2 weight percent water; (b) greater than about 60 weight percent crystalline fructose; (c) less than about 35 weight percent amorphous fructose; (d) about 2 to 8 weight percent glucose; and (e) about 2 to 8 weight percent polysaccharides distributed predominantly at or on the surface of the granules such that the hygroscopicity of the granule is reduced from that of a granule having a uniform distribution of polysaccharides.

By virtue of its reduced hygroscopicity, this composition has a reduced tendency to become tacky and/or agglomerate when exposed to conditions of high humidity.

DETAILED DESCRIPTION OF THE INVENTION

A. Process In General

Figure 1:
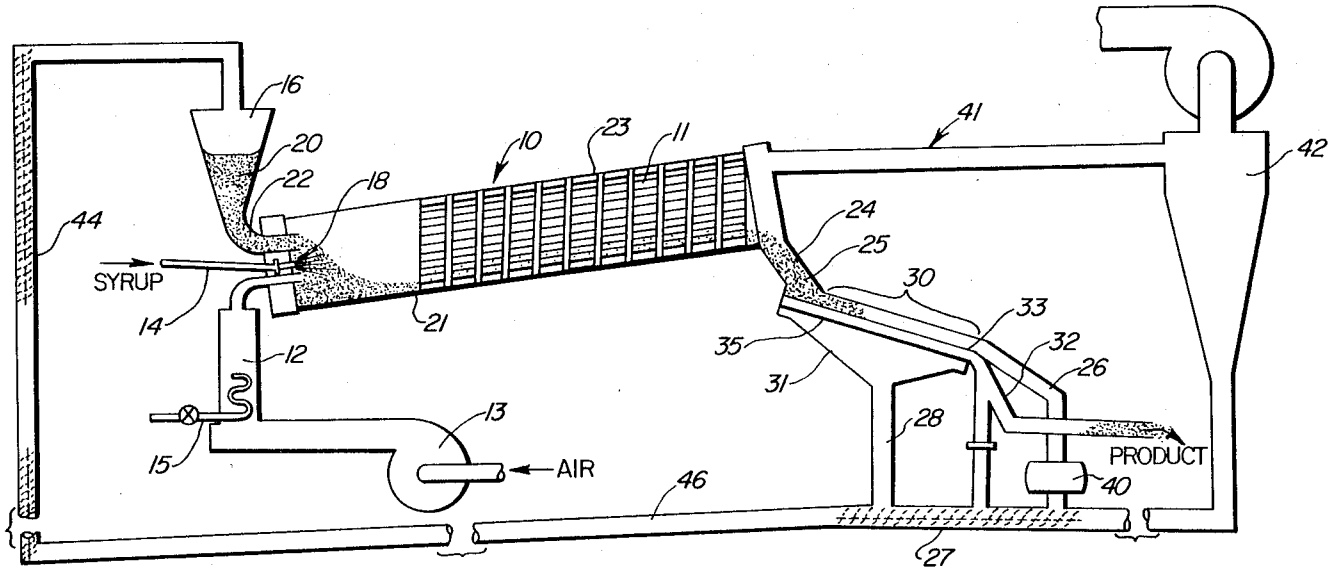
FIG. 1 is a flow sheet for the preferred embodiment of the process of this invention.

The process of this invention is a method for preparing a free-flowing, granular, semi-crystalline, solid fructose product which can be used as a substitute for crystalline fructose and/or crystalline sucrose. The first element of the process is to combine together an aqueous fructose syrup and a solid crystallization initiator. The second element is to contact the combined fructose syrup and crystallization initiator with air to effect drying and crystallization. The third element of the process is to recover the solid fructose product having less than about 2 weight percent water and more than about 60 weight percent crystalline fructose. The process can be carried out batchwise, but the continuous mode is greatly preferred because of the increased production rate and the ready availability of continuous-type processing equipment.

B. Aqueous Fructose Syrup

The aqueous fructose syrup used in this invention comprises about 60 to 93 weight percent saccharide with the balance of the syrup being predominantly water. Because of the cost and time required for drying, the aqueous fructose syrup preferably has as high a saccharide content as can be handled. The preferred saccharide concentration at ambient temperatures is about 70 to 80 weight percent. Somewhat higher saccharide concentrations, up to about 93 weight percent, can be used if the temperature of the fructose syrup is elevated to reduce viscosity. However, prolonged periods at temperatures above about 110° C. should be avoided because of damage to the fructose. A preferred aqueous fructose syrup at elevated temperatures is obtained by evaporating a syrup at atmospheric pressure to a temperature of about 118° to 130° C. to obtain a saccharide concentration of about 85 to 91 weight percent. The concentrated syrup, which can be viewed as a molten solid, is then immediately combined with the crystallization initiator and contacted with air. The rapid cooling by the air and the partial melting of the crystallization initiator lowers the temperature of the fructose to protect it from the harmful effects of prolonged heat.

About 85 to 100 weight percent of the saccharide in the aqueous fructose syrup is fructose. To obtain a solid fructose product of maximum sweetness, it is, of course, preferred to maximize the fructose concentration. It is also preferred to maximize fructose concentration to maximize the rate of crystallization. Fructose solutions containing nearly 100 weight percent fructose on a dry substance basis can be obtained by hydrolyzing inulin or by isolating fructose from fructose-glucose mixtures produced by hydrolyzing sucrose or isomerizing glucose. However, such essentially pure fructose solutions are relatively expensive. Therefore, the preferred aqueous fructose syrup is obtained by the liquid chromatographic separation of a fructose-glucose syrup comprising, on a dry substance basis, about 42 weight percent fructose, about 54 weight percent glucose, and about 4 weight percent polysaccharides which is, in turn, obtained by the isomerization of a high D.E. (dextrose equivalent) corn syrup. Liquid chromatographic separation routinely produces a fructose syrup comprising, on a dry substance basis, about 88 to 95 weight percent fructose, about 2 to 8 weight percent glucose, and about 2 to 8 weight percent polysaccharides. The aqueous fructose syrup is generally maintained at a pH of about 3.0 to 5.5 to prevent reversion of the fructose to glucose. Ion exchange refining is commonly used to meet food tolerances by removing impurities.

C. The Crystallization Initiator

The solid crystallization initiator used in this process is a free-flowing, particulate solid capable of absorbing the fructose syrup which both induces crystallization of the fructose syrup in the metastable phase and which serves as a carrier for the fructose syrup to permit the desired degree of crystallization and drying to occur. The chemical composition of the initiator is not critical in inducing crystallization or in serving as a carrier. However, the initiator is intimately mixed with the fructose syrup and becomes part of the solid fructose product. Therefore, it is highly desirable that the initiator be edible and pleasant tasting. Most starches and sugars are suitable, but the preferred initiator is a fructose solid. A more preferred crystallization initiator is a fructose solid comprising greater than about 85 weight percent fructose and greater than about 60 weight percent crystalline fructose. Once the process of this invention has begun and product is produced, a portion of the product is conveniently recycled as the initiator. Accordingly, the most preferred crystallization initiator has the same properties of the solid fructose product.

D. Relative Amounts of Syrup and Initiator

The weight ratio of crystallization initiator to fructose syrup is generally about 5:1 to 40:1. Ratios below about 5:1 are avoided because the combined particles become too sticky and tend to agglomerate. Ratios above about 40:1 are impractical because the size of the available equipment limits the amount of the combined particles which can be contacted with air at a given time and therefore limits both the feed rate of the aqueous fructose syrup and the corresponding production rate. By way of illustration, for a given syrup rate, as the weight ratio increases from 5:1 to 40:1, the weight of the combined particles being contacted with air at a given time increases by a factor of 6.8 (40+1/5+1). The weight ratio of crystallization initiator to fructose syrup is preferably about 7:1 to 15:1.

E. Air

The air used to contact the combined fructose syrup and crystallization initiator has an initial temperature of about 50° to 80° C. and a final relative humidity of less than about 20 percent. Initial air temperatures below about 50° C. are generally avoided because the rate of drying is too slow to be practical whereas temperatures above about 80° C. are generally avoided because the rate of drying is too fast to permit the desired degree of crystallization to occur. Furthermore, initial air temperatures above about 80° C. can cause degradation of the fructose if the fructose syrup is at elevated temperatures.

The final air relative humidity is maintained below about 20 percent to provide a sufficient difference between the activities of the water in the fructose and of the water in the air to promote drying. The air flow rate and the initial humidity of the air are controlled to ensure that the final air relative humidity is below about 20 percent.

F. Means of Contacting

The means for contacting the combined fructose syrup and crystallization initiator with the air is not especially critical. However, the contacting must occur in such a way that crystallization of the fructose proceeds to the desired degree. In other words, extremely fast methods of drying such as flash or spray-drying are not desirable. The preferred means of contacting is to perform the crystallization and drying in a single vessel such as a conventional rotary drum dryer, moving belt dryer, fluidized bed dryer, or the like. The most preferred means is to employ a rotary drum dryer as the crystallizer-dryer.

In a rotary drum dryer, the combined fructose syrup and crystallization initiator is tumbled and cascaded and thereby contacted with the air as it moves through the drum. The crystallization phase of the process merges with the drying phase as the water is removed. The drum is preferably canted upward from the feed end to the exit end. The angle is chosen in combination with the drum rotation speed to fix the residence time per pass. The average residence time is a function of both the residence time per pass and the amount of recycle, if any. As mentioned above, the recycle ratio is equal to the weight ratio of crystallization initiator to fructose syrup in the preferred mode of operation. The average residence time is generally about 12 to 48 hours and is chosen to obtain the desired moisture level and degree of crystallinity in the product. When a fructose syrup comprising about 85 to 91 weight percent saccharide with the saccharides comprising about 88 to 95 weight percent fructose is used, the average residence time is generally about 15 to 24 hours.

G. Solid Fructose Product

The solid fructose produced by the process of this invention is free-flowing, granular, and semi-crystalline. The product has a moisture level of less than about 2 weight percent water, and preferably less than about 1 percent water. Most preferably, the product has less than about 0.7 weight percent water. Low moisture levels are desired to prevent problems in applications. The fructose product is hygroscopic and is generally sealed in vapor-barrier containers, especially when the relative humidity of the ambient air is high.

The product comprises greater than about 60 weight percent crystalline fructose and preferably comprises greater than about 75 weight percent crystalline fructose. The method used to determine the amount of crystalline fructose in the product is described below. The total amount of fructose in the product (crystalline plus amorphous) is generally a function of the fructose concentration in the syrup. The product preferably comprises greater than about 85 weight percent total fructose.

As previously discussed, the moisture level and degree of crystallinity in the product are functions of many factors, including average residence time, solids level in the fructose syrup, fructose concentration in the fructose syrup, air flow rate, air temperature, and air relative humidity.

The particle size of the product is affected by the drying conditions and is generally adjusted by recycling undersized particles and by grinding oversized particles. The product size is adjusted to meet the intended use, but generally is about the same size as currently available crystalline fructose and crystalline sucrose. Accordingly, the preferred product has a size distribution such that 100 weight percent passes through a U.S. Standard 20 mesh screen and at least 85 weight percent is retained on a U.S. Standard 60 mesh screen.

The solid fructose product obtained by treating the preferred aqueous fructose syrup according to the process of this invention exhibits a hygroscopicity which is less than that expected based on its composition. This product consists essentially of: (a) less than about 2 weight percent water; (b) greater than about 60 (preferably greater than about 75) weight percent crystalline fructose; (c) less than about 35 (preferably less than about 20) weight percent amorphous fructose; (d) about 2 to 8 weight percent glucose; and (e) about 2 to 8 weight percent polysaccharides. Apparently the polysaccharides, which have relatively low hygroscopicities, are present predominantly at or on the surface of the granules and thereby account for this surprising and advantageous property.

The solid fructose product obtained by this process is used in virtually any application where crystalline fructose or crystalline sucrose is used. Since the product has a sweetness greater than that of sucrose, less of it needs to be used and the resulting product has a lower caloric value.

H. Preferred Embodiment

FIG. 1 is a flow sheet for a preferred embodiment of the process of this invention.

A conventional rotary drum dryer 10 fitted with baffles 11 or flights to cascade the solids through the drying air is employed as the crystallizer-dryer. Air at a temperature of about 70° C. and a relative humidity of less than about 10 percent is delivered to the crystallizer-dryer through duct 12. To provide air at these conditions, ambient air is delivered by blower 13 to a steam coil 15. Depending on the humidity of the ambient air, water removal may be necessary.

An aqueous fructose syrup at about 25° C. having about 77 weight percent saccharide, about 95 weight percent of which is fructose, is pumped through line 14 to spray nozzles 18 in the crystallizer-dryer. Recycled product 20 having about 0.5 weight percent water and about 75 weight percent crystalline fructose is used as the crystallization initiator and is fed from a hopper 16 to the crystallizer-dryer through line 22.

The fructose syrup is sprayed into the tumbling bed 21 of recycled product at a weight ratio of recycled product to fructose syrup of about 8:1. The combined syrup-recycled product is tumbled and conveyed through the crystallizer-dryer by baffles 23.

The dried, crystalline fructose product 25 flows from the crystallizer-dryer through line 24 to the classifier 30 for separation according to particle size. The classifier contains an upper screen 33 of the U.S. Standard 20 mesh to retain oversized particles. The oversized particles pass through line 26 to a mill 40 such as a Fitzmill grinder. The mill is set to yield product of a size equal to or smaller than the desired particle size. The ground material is returned to the crystallizer-dryer by way of conveyor 27, lines 46 and 44, and the hopper.

The classifier also contains a lower screen 35 of U.S. Standard 60 mesh to retain the desired-size particles which pass through line 32 for collection. The undersized particles pass through the 60 mesh screen into line 28 and are returned to the crystallizer-dryer by way of conveyor 27, lines 46 and 44, and the hopper. Fines in the exhaust are separated in cyclone 42, and are then returned to the crystallizer-dryer by way of conveyor 27, lines 46 and 44, and the hopper.

I. Theory

Figure 2:
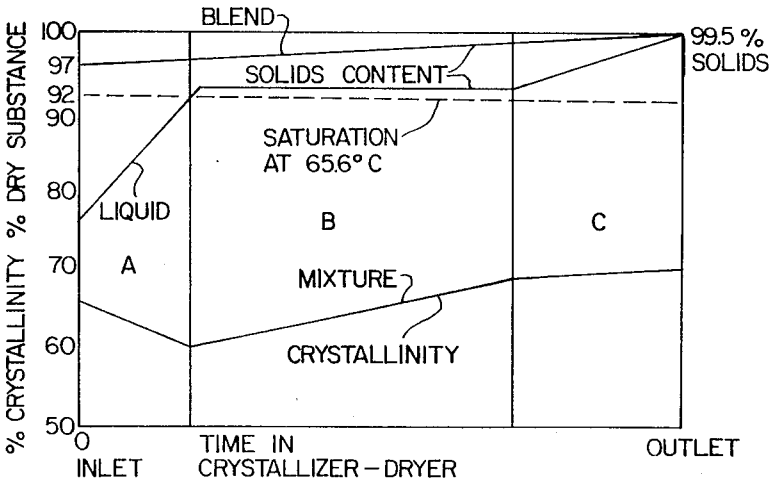
FIG. 2 is a graph illustrating certain changes in the fructose during the process of this invention.

While not wishing to be bound by theory, the physical changes occurring to the combined fructose syrup and crystallization initiator as it passes through the crystallizer-dryer described above are believed to be as shown in FIG. 2. In FIG. 2, the abscissa (the x-axis) represents the time in the crystallizer-dryer from inlet to outlet. The left ordinate (the y-axis) represents percent crystallinity of the combined fructose syrup and crystallization initiator ("the mixture"). The effect of time on percent crystallinity is shown by the line labeled "Mixture-Crystallinity". The left ordinate also represents percent dry substance in both the liquid phase and in the combined fructose syrup and crystallization initiator ("the blend"). The effect of time on percent dry substance in the liquid phase is shown by the line labeled "Liquid-Solids Content". The effect of time on percent dry substance in the blend is shown by the line labeled "Blend-Solids Content". The broken line parallel to the abscissa represents the percent dry substance at saturation. The time scale and intermediate points are calculated or chosen arbitrarily for illustration.

The assumptions for FIG. 2 are as follows: (1) an aqueous fructose syrup having 77 weight percent saccharide, 95 weight percent of which is fructose; (2) use of recycled product as the crystallization initiator; (3) a weight ratio of initiator to syrup of 10:1; and (4) a solid fructose product having 0.5 weight percent water and 70 weight percent crystalline fructose.

The first changes occurring during passage through crystallizer-dryer may be visualized as represented by area A. The fructose is distributed in the syrup feed and in the solid. As shown, there is likely to be small decline in average crystallinity as the liquid dissolves some of the fructose of the recycled solids, and this will, of course, depend on concentrations. During this time (area A), some of the water is removed so that when the liquid concentration reaches saturation, crystallization from the liquid is initiated. Then (area B) average crystallinity rises steadily toward the crystallinity value of the product. The solids content of the liquid phase may be visualized as remaining essentially constant during this period at saturation while both water is removed and crystallization continues. The average solids content of the mixture rises continually as water is removed. Finally, in the last period of the passage through the crystallizer-dryer (area C), solids content of the liquid rises more rapidly. With the decrease in water content, the rate of crystallization declines while crystallinity continues to increase.

J. Method of Determining Crystallinity

The semi-crystalline fructose product of this invention is often described as comprising a certain percentage of crystalline fructose. This percentage is an approximation determined by a method which compares the heat of fusion of the semi-crystalline fructose product with the heat of fusion of a product assumed to be 100 percent pure crystalline fructose. The method is based on the fact that the heat of fusion of an amorphous solid is zero and ignores the effect of any crystalline non-fructose components in the product.

The instrument used to measure heat of fusion is a Perkin-Elmer Model DSC-2C differential scanning calorimeter manufactured by the Perkin-Elmer Corporation of Norwalk, Conn. The calorimeter is first calibrated using an indium standard, as prescribed by the manufacturer. The indium standard is heated from 130° C. to 160° C. at the rate of 10° C. per minute, cooled back down to 130° C., and then heated to 160° C. again. The two endotherms are recorded on a chart recorder, the areas under the peaks are measured, and the results averaged. A dimensionless calibration constant, K, is then calculated from the following equation:

$$K=(6.788)(W)(B)(I)/(5)(A)(60)$$

where

K = dimensionless calibration constant
W = weight of indium in milligrams
B = chart speed in inches per minute
I = chart width in inches
A = area under indium endotherm in square inches A product assumed to be 100 percent pure crystalline fructose is obtained from Hoffmann-LaRoche Inc. This product is dried under vacuum at 55° C. for about one hour to remove any traces of water. A weighed sample is then placed into the calorimeter and heated from 60° C. to 145° C. at the rate of 10° C. per minute, cooled to 60° C., and then heated again to 145° C. The average area under the endotherm peaks is determined as before. The heat of fusion, H, is calculated from the following equation:

$$H=(K)(A)(5)(4.187)(60)/(W)(I)(B)$$

where

H = heat of fusion in Joules per gram
K = dimensionless calibration constant
A = area under fructose endotherm in square inches
W = weight of sample in milligrams
I = chart width in inches
B = chart speed in inches per minute The heat of fusion of the semi-crystalline fructose product is computed in the same manner and is then divided by the heat of fusion of the pure crystalline fructose. The resulting fraction is believed to be a useful approximation of the percentage of crystalline fructose in the semi-crystalline fructose product.

K. Examples

These examples are illustrative only.

EXAMPLE I

A conventional rotary drum dryer was employed to crystallize and dry the fructose syrup. The dryer had a diameter of about 0.76 meters, a length of about 4.3 meters, and a pitch of about 3.5 centimeters per meter rising toward the exit end. It rotated at the rate of about 6 r.p.m. The dryer was initially loaded with about 107 kilograms of a semi-crystalline fructose crystallization initiator having about 0.7 weight percent water and about 75 weight percent crystalline fructose. This crystallization initiator was obtained from a prior run originally seeded with 100 percent pure crystalline fructose obtained from Hoffmann-LaRoche Inc.

An aqueous fructose syrup at a temperature of about 120° C. was pumped through a spray nozzle located inside the dryer onto the tumbling bed of crystallization initiator at the rate of about 6.0 kilograms per hour. The syrup was about 90 weight percent saccharides and about 10 weight percent water. The saccharides comprised about 90 weight percent fructose, about 5 weight percent glucose, and about 5 weight percent polysaccharides. The fructose syrup was obtained from the liquid chromatographic separation of a glucose-fructose syrup.

The combined fructose syrup and crystallization initiator was dried with air at an initial temperature of about 67° C. and an initial dew point of about 4° C. The air flowed concurrently through the rotary drum dryer at a rate of about 7000 liters per minute.

The dried, semi-crystalline product leaving the dryer was fed to a screening device fitted with a 20-mesh screen and a 60-mesh screen. Oversized particles, retained on the 20-mesh screen, were delivered to a Fitzmill grinder fitted with a 10-mesh screen. The ground particles and the undersized particles, which passed through the 60-mesh screen, were recycled to the drum dryer to serve as the crystallization initiator. In addition, a portion of the desired-sized particles, retained on the 60-mesh screen, were recycled so that the total recycle was about 60 kilograms per hour, giving a weight ratio of crystallization initiator to fructose syrup of about 10:1. The average residence time in the drum dryer was about 24 hours.

A free-flowing, granular, semi-crystalline, solid fructose product was withdrawn at the rate of about 3.5 kilograms per hour (the balance of the dry substance was lost from the equipment due to less-than-ideal seals). The product contained about 0.7 weight percent water, about 75 weight percent crystalline fructose, about 14 weight percent amorphous fructose, about 5 weight percent glucose, and about 5 weight percent polysaccharides.

EXAMPLE II

The procedure of Example I was repeated with a different aqueous fructose syrup. The syrup was about 77 weight percent saccharide and about 23 weight percent water. The saccharides comprised about 95 weight percent fructose, about 3 weight percent glucose, and about 2 weight percent polysaccharides. The syrup was pumped to the dryer at the rate of about 8.3 kilograms per hour. The product contained about 0.5 weight percent water and about 80 weight percent crystalline fructose.

I claim:

1. A process for preparing free-flowing, granular, semi-crystalline, solid fructose which comprises:

(a) combining together an aqueous fructose syrup comprising about 60 to 93 weight percent saccharide, about 85 to 100 weight percent of the saccharide being fructose, and a solid crystallization initiator in a weight ratio of crystallization initiator to fructose syrup of about 5:1 to 40:1;

(b) contacting the combined fructose syrup and crystallization initiator with air having an initial temperature of about 50° to 80° C. and a final relative humidity of less than about 20 percent for a period of time of about 12 to 48 hours to transform the combined fructose syrup and crystallization initiator to a free-flowing, granular, solid fructose product comprising less than about 2 weight percent water and greater than about 60 weight percent crystalline fructose; and (c) recovering the free-flowing, granular, semi-crystalline, solid fructose product.

2. The process of claim 1 wherein the crystallization initiator comprises greater than about 85 weight percent fructose and greater than about 60 weight percent crystalline fructose.

3. The process of claim 2 wherein the weight ratio of crystallization initiator to fructose syrup is about 7:1 to 15:1.

4. The process of claim 3 wherein the combined fructose syrup and crystallization initiator are contacted with air in a rotary drum dryer.

5. The process of claim 4 wherein the fructose syrup comprises about 85 to 91 weight percent saccharide and the saccharides consist essentially of about 88 to 95 weight percent fructose, about 2 to 8 weight percent glucose, and about 2 to 8 weight percent polysaccharides.

6. The process of claim 5 wherein the combined fructose syrup and crystallization initiator are contacted with air for a period of time of about 15 to 24 hours.

7. The process of claim 6 wherein the solid fructose product comprises less than about 1 weight percent water and greater than about 75 weight percent crystalline fructose.

8. The process of claim 7 wherein a portion of the solid fructose product is recycled as the crystallization initiator.

9. A free-flowing, granular, semi-crystalline, solid fructose composition which consists essentially of:

(a) less than about 2 weight percent water;

(b) greater than about 60 weight percent crystalline fructose;

(c) less than about 35 weight percent amorphous fructose;

(d) about 2 to 8 weight percent glucose; and (e) about 2 to 8 weight percent polysaccharides distributed predominantly at or on the surface of the granules such that the hygroscopicity of the granule is reduced from that of a granule having a uniform distribution of polysaccharides.

10. The composition of claim 9 comprising less than about 1 weight percent water, greater than about 75 weight percent crystalline fructose, and less than about 20 weight percent amorphous fructose.

* * * * *